US011952161B2

(12) United States Patent
LeBlanc

(10) Patent No.: US 11,952,161 B2
(45) Date of Patent: Apr. 9, 2024

(54) APPARATUS, SYSTEM AND METHOD FOR CAPPING BAT PIPES

(71) Applicant: Pre-Pack, Inc., Narragansett, RI (US)

(72) Inventor: Jeffrey LeBlanc, East Greenwich, RI (US)

(73) Assignee: Pre-Pack, Inc., Narragansett, RI (US)

( * ) Notice: Subject to any disclaimer, the term of this patent is extended or adjusted under 35 U.S.C. 154(b) by 13 days.

(21) Appl. No.: 17/558,282

(22) Filed: Dec. 21, 2021

(65) Prior Publication Data

US 2022/0194637 A1 Jun. 23, 2022

Related U.S. Application Data

(60) Provisional application No. 63/130,289, filed on Dec. 23, 2020.

(51) Int. Cl.

| | |
|---|---|
| ***B65B 7/28*** | (2006.01) |
| ***A24F 1/28*** | (2006.01) |
| ***A24F 5/10*** | (2006.01) |
| ***A24F 9/02*** | (2006.01) |

(52) U.S. Cl.

CPC ..... *B65B 7/2821* (2013.01); *A24F 1/28* (2013.01); *A24F 5/10* (2013.01); *A24F 9/02* (2013.01)

(58) Field of Classification Search

CPC .. B65B 7/2821; A24F 1/28; A24F 5/10; A24F 9/02

See application file for complete search history.

(56) References Cited

U.S. PATENT DOCUMENTS

| | | | | |
|---|---|---|---|---|
| 5,937,616 | A * | 8/1999 | Ray | B65B 7/2821 53/316 |
| 10,071,021 | B2 * | 9/2018 | Calvert, II | A61J 3/074 |
| 10,604,292 | B1 * | 3/2020 | Dodson | B65B 39/00 |
| 2016/0235115 | A1 * | 8/2016 | Han | A24F 1/28 |
| 2017/0183113 | A1 * | 6/2017 | Deutschle | G01G 17/06 |
| 2018/0134423 | A1 * | 5/2018 | Narvekar | B65B 43/59 |
| 2021/0212359 | A1 * | 7/2021 | Davis | A24F 1/28 |

* cited by examiner

*Primary Examiner* — Andrew M Tecco
*Assistant Examiner* — Nicholas E Igbokwe
(74) *Attorney, Agent, or Firm* — Hinckley, Allen & Snyder, LLP; David R. Josephs

(57) ABSTRACT

An apparatus, system and method for capping an array of bat pipes. A cap rack is provided with a frame, runners and a matrix of caps. The matrix of caps are aligned respectively over the top open ends of array of bat pipes filled with smokable material. A press tool, having a matrix of pegs and ribs, is aligned over the matrix of caps. Downward pressure of the press tool is applied into the cap rack thereby pressing the matrix of caps into sealed engagement with respective top open ends of the bat pipes. The downward pressure of the ribs of the press tool into the cap rack separates the frame and runners of the cap rack from the matrix of caps leaving the matrix of caps seated in respective top open ends of the bat pipes leaving the array of bat pipes ready for sale, shipping or the like.

14 Claims, 10 Drawing Sheets

APPARATUS, SYSTEM AND METHOD FOR CAPPING BAT PIPES

CROSS REFERENCE TO RELATED APPLICATIONS

This application is related to, and claims benefit from, U.S. Provisional Application No. 63/130,289, filed on Dec. 23, 2020, entitled "APPARATUS, SYSTEM AND METHOD FOR CAPPING BAT PIPES," incorporated by reference in its entirety, herein.

BACKGROUND OF THE INVENTION

The present invention generally relates to the manufacture of smoking products, and more particularly, to apparatus, systems, and methods for efficiently capping smoking devices with ground plant matter. In particular, the present invention relates to an apparatus, system, and method for capping a bat pipe for storage of the smokable plant matter therein and for later smoking the smokable plant matter using the same device. The present invention is applicable to all industries that utilize herbal material, including but not limited to tobacco, spices, and ground smokable plant matter.

Many of the chemical compounds synthesized by plants have been found to have favorable, enjoyable, or beneficial effects when consumed by humans. These effects can be either short-term or long-term, and they may impact a human's health, mental state, and/or other attributes. As a result, humans have taken to the consumption of plant-synthesized chemical compounds (also known as "phytochemicals") for both medicinal and recreational purposes.

As a means for consuming phytochemicals, humans have adopted the practice of smoking, where plant matter containing phytochemicals, such as tobacco or *Cannabis*, is burned to produce inhalable smoke. Humans have created several devices to facilitate smoking, such as pipes or hookahs, but many prefer the convenience of carrying the smokable plant matter in the same device as the pipe used for smoking the plant matter. This also facilitates the sale of the plant matter in a convenient and ready-to-use form where the smokable plant matter is pre-filled and the package can be clearly marked for ease of sale and purchase by the consumer with clarity of the contents filled therein.

It is well known in the art to provide a smoking device 10, such as bat type pipe device, as shown in FIG. 1. These devices 10 typically include a cylindrical body 12 with a smokable plant storage chamber 14 and a smoke chamber 16 with a small passage 18 fluidly connecting the two chambers 14, 16 together. The smoke chamber includes an intake hole 20 by which the user draws the smoke. The plant storage chamber 14, which also acts as a bowl for holding smokable plant matter 22 during combustion and smoking, has an open end 24. A cap 26 is or can be provided to seal the plant storage chamber 14 after it is filled with smokable plant matter 22 to retain the smokable plant matter 22 during shipping and storage. The cap 26 shown is one example of the different types and configurations of caps that may be used to seal the plant storage chamber 14. The cap 26, which is commonly plastic or other material, preferably includes sealing elements in the form a circumferential flange 26*a* and/or stopper like member 26*b* to provide a releasable friction fit.

Bat pipes 10 are typically capped by a manual capping process whereby the smokable plant matter 22, which is typically ground first, is loaded into the plant storage chamber 14 when the bat pipe 10 is in a vertical position with the open end 24 of the plant storage chamber 14 facing upwards. After filling to the desired amount, the cap 26 is manually inserted into the open ended smokable plant storage chamber 14 and is typically retained in place by the friction fit. As a result, the smokable plant matter 22 is contained and stored within the bat pipe 10, which facilitates shipping, storage, and transit by the user. However, as can be understood, manually capping multiple bat pipes is labor intensive, time consuming and expensive.

As is also well-known, when the user desires to smoke the smokable plant matter 22, the cap 26 is removed and the smokable plant matter 26 is exposed and then combusted using a flame or some form of igniting device while air is drawn through the intake hole 20 on the opposing side.

While this capping process is suitable on a small scale or for individual use, it is not suitable for large scale production and capping of such devices 10. Also, as pre-filled containers and pipe devices 10 become more popular with a demand for known and consistent commoditized smokable products, it has become important that the capping of such devices 10 be as fast as possible and be carried out at the same time for large scale mass production.

Therefore, there is a need for an apparatus, system and method for capping bat pipes and other storage devices that address the foregoing concerns.

SUMMARY OF THE INVENTION

The apparatus, system and method of the present invention is configured for speed capping of containers/bat pipes that reside in a packing container box loaded with containers, hereinafter referred to as bat pipes for ease of discussion, that have been filled with the desired amount of ground smokable plant matter. For example, a packing box where an array of bat pipes, such as an array of 50, 100, 150, 250 or other number of bat pipes, are ready to be filled with their top open ends filled with ground smokable plant matter with open top ends exposed in preparation for capping after they are filled.

The present invention includes a cap rack that includes of a matrix of caps that aligns concentrically with the open top ends of the bat pipes. Further the cap rack has a number of runners that hold the caps in position and a frame to bind all the cap rack components together as one common part.

The present invention also includes a press tool that includes of a matrix of pegs that align with the matrix of open top ends of the caps found on the cap rack. The press tool incorporates a series of alignment indicators to help in positioning the press tool to the cap rack. Furthermore, the press tool has a system of integrated runners and post detailing that sequences and engages the runners that interlock the caps together within the cap rack. Downward pressure of the press tool seats the caps into the top open ends of the smokable plant storage chambers of the bat pipes. This downward pressure also engages the press tool ribs to force the cap rack runners downward. In addition, to prevent the runners from flexing out of the way and not properly shearing, the rib posts straddle the thin cap rack runners to ensure that they are fully engaged and properly captured during compression. A bottom surface of the press tool can be curved to allow it to be rocked from side to side. This motion helps to provide a controlled rolling transfer of this localized pressure across the runners of the cap rack. Alternatively, the bottom surface of the press tool may be flat where the press tool is pressed directly downward into the cap rack.

In accordance with the use of the present invention, the press tool provides an important function to compress and seat the cap rack caps into position into the top open ends of the smokable plant storage chambers to seal the smokable plant matter therein. Also, in accordance with an alternative embodiment of the present invention, it is also possible to hand press the cap rack into the top open ends of the smokable plant storage chambers without the use of the press tool. For example, the operator could methodically press the cap rack down simply by using their hands thereby positioning the caps into position and then press them manually and individually into sealing engagement with the storage chambers. After all the caps are seated, the frame and runners can then be stripped away and then discarded. Such a process might be more convenient in certain circumstances, such as in smaller processing batches.

The operation of the apparatus, system and method of the present invention requires placing the cap rack onto the matrix of bat pipes. Applying downward pressure to the press tool and side to side rocking while in position on the cap rack will both compress the caps into proper position on the smokable plant storage chambers of the bat containers as well as release of the cap rack runners and frame from the cap rack part. At this point the bat pipes are all cap sealed, still in container package and ready for processing to customers, such as presentation for sale, storage or shipping.

Therefore, an object of the present invention is to provide an apparatus, system and method that can cap multiple containers quickly at the same time.

There is a further object of the present invention to provide such an apparatus, system and method that reduces costs by materially reducing time and labor.

Moreover, there is an object of the present invention to streamline the preparation of the containers and capping process.

There is yet another object of the present invention to avoid the need to remove the containers to be capped from their bulk shipping container package thereby substantially reducing handling, labor, costs, waste, and breakage of the containers.

Another object of the present invention to compress/pack the smokable plant matter in the container to eliminate mounding and spillage of smokable plant matter.

BRIEF DESCRIPTION OF THE DRAWING FIGURES

The novel features that are characteristic of the present disclosure are set forth in the appended claims. However, the disclosure's preferred embodiments, together with further objects and attendant advantages, will be best understood by reference to the following detailed description taken in connection with the accompanying drawings in which:

DESCRIPTION OF THE INVENTION

Figure 1:
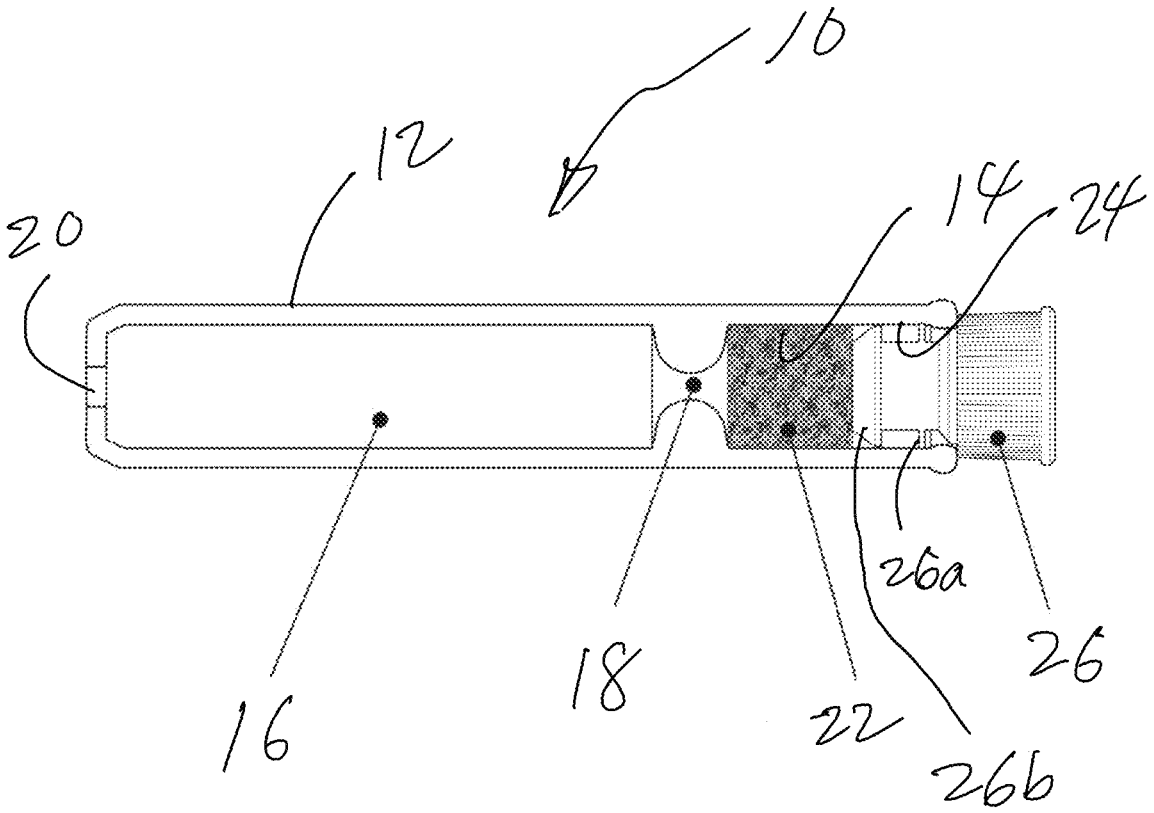
FIG. 1 shows a side view of the components of a glass bat pipe with added sealing cap in place.
Figure 2:
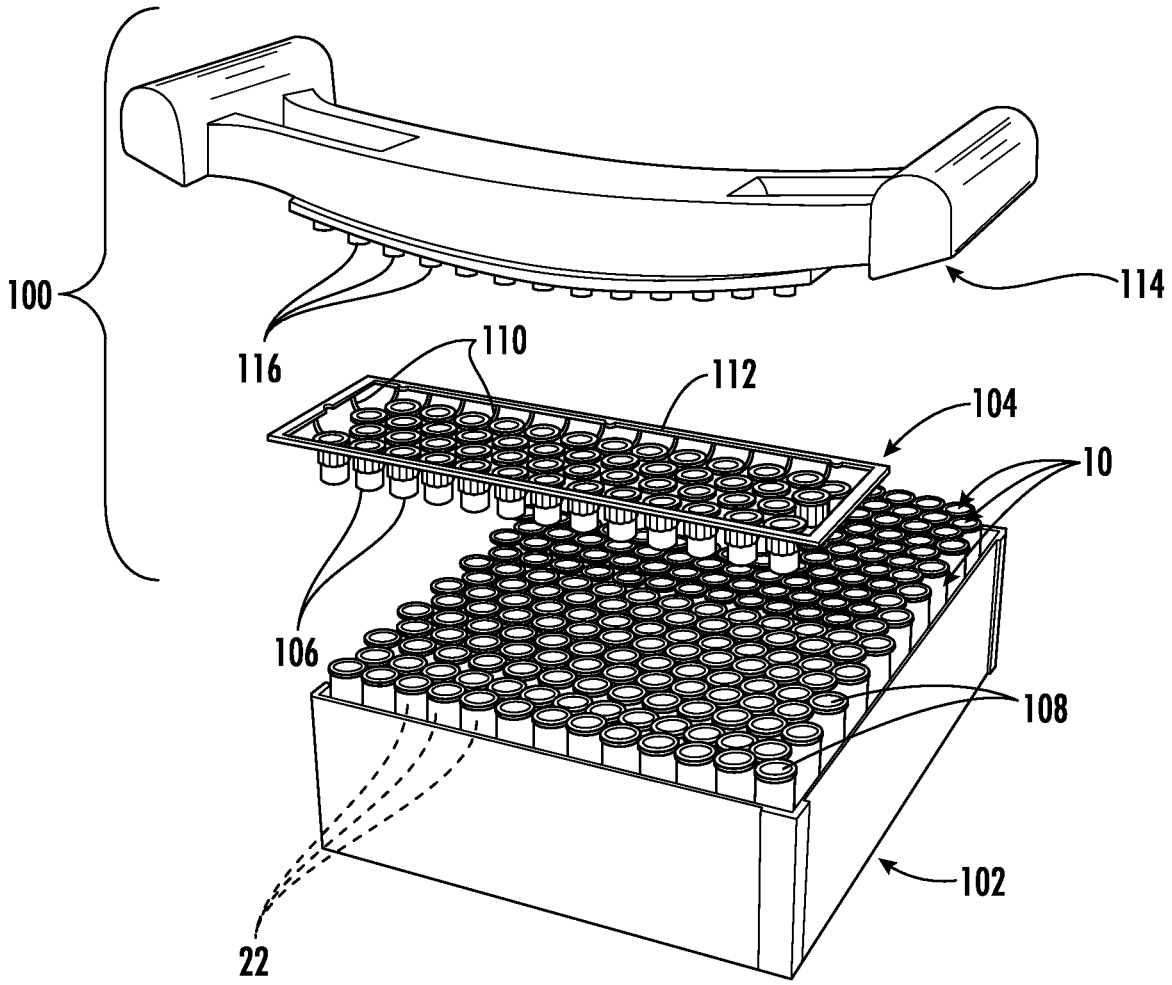
FIG. 2 shows an exploded perspective view of the capping system of the present invention that includes a press tool and cap rack for capping glass bats residing in a packing container box.
Figure 3:
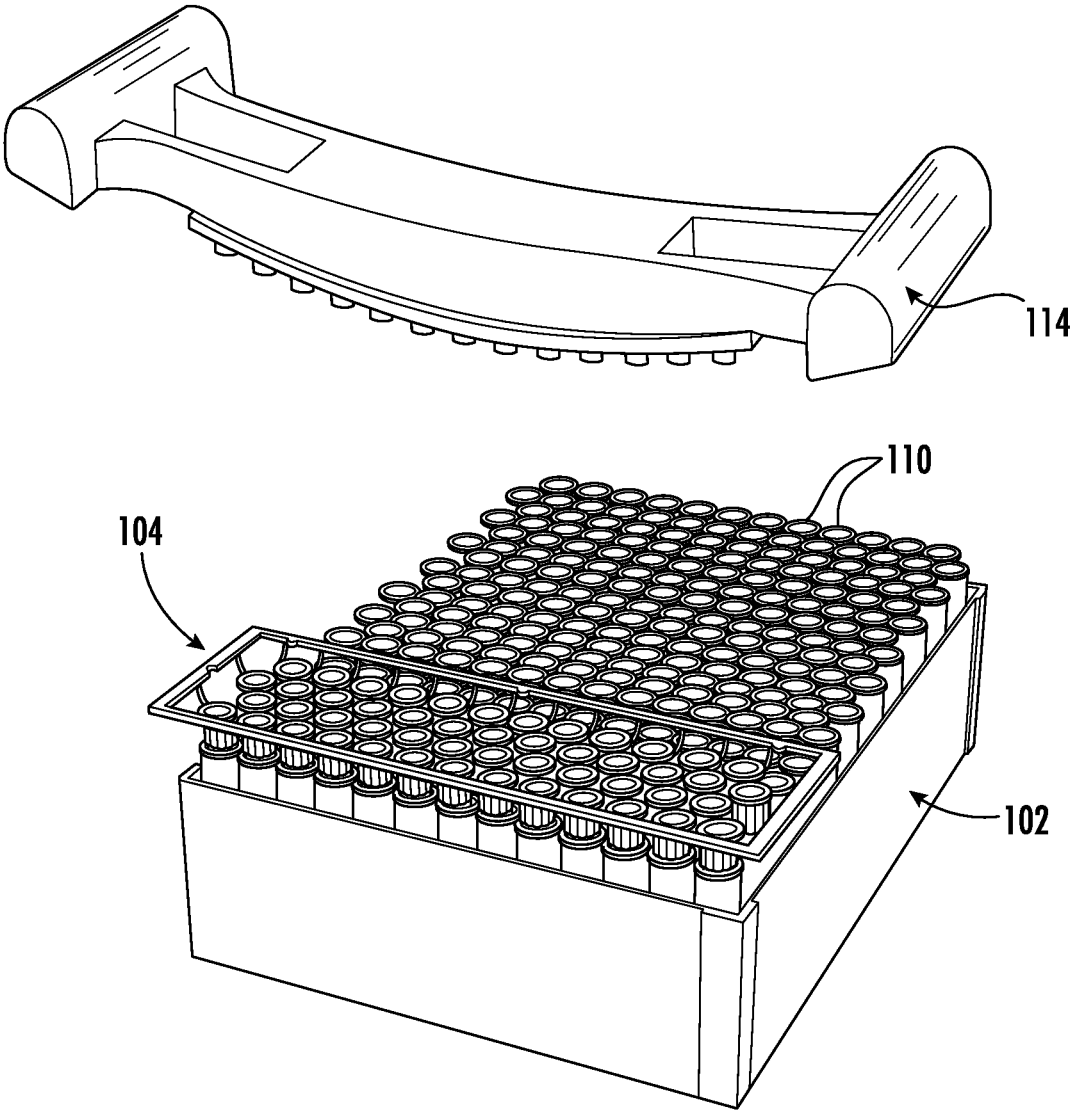
FIG. 3 shows preliminary positioning and alignment of the press tool over the placed cap rack.

In accordance with the present invention, the bat pipes 10 to be filled reside in a containing device such as a shipping container, a box or packing platform 102. As can generally be seen in FIGS. 2 and 3, the system of the present invention, generally referred to as 100, includes two primary components: a cap rack 104, carrying a matrix of caps 106, and a press tool 114 with a number of pegs 116 and ribs 120 on the bottom surface thereof, as will be described in detail below. The system 100 provides speed capping of bat pipes 10 residing in a packing container 102, also seen in FIGS. 2 and 3.

Figure 4A:
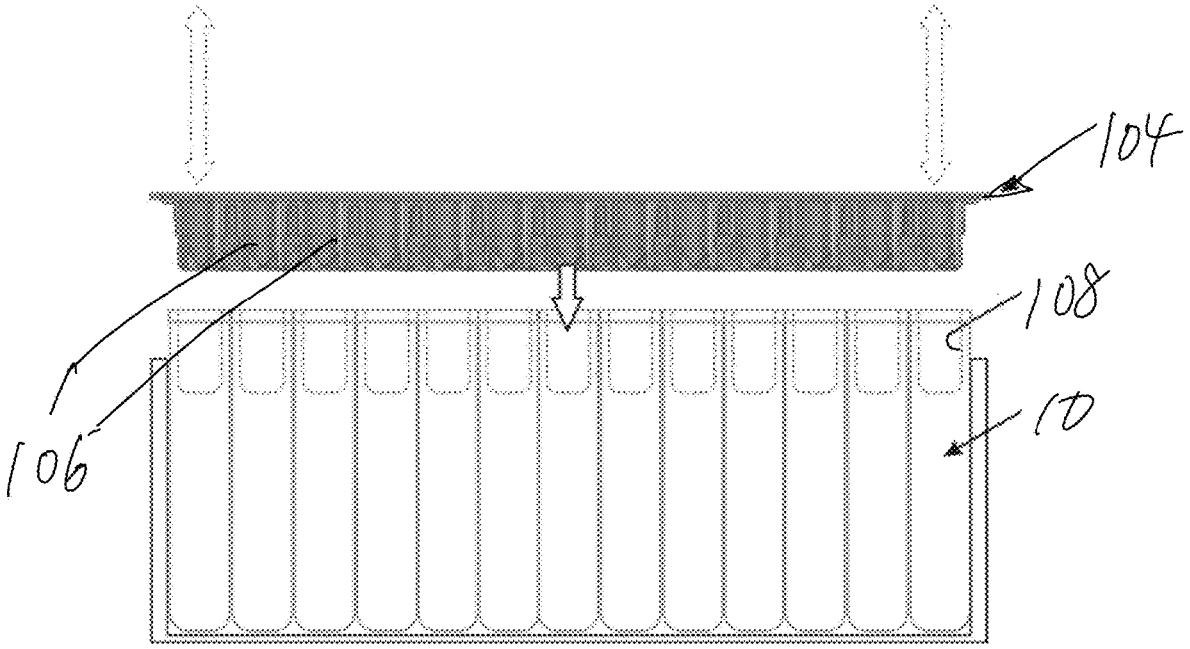
FIG. 4A shows a side elevational view of the cap rack positioned over the matrix of bat pipes where the caps of the cap rack match the matrix position of the smokable plant storage chambers of the glass bats.
Figure 4B:
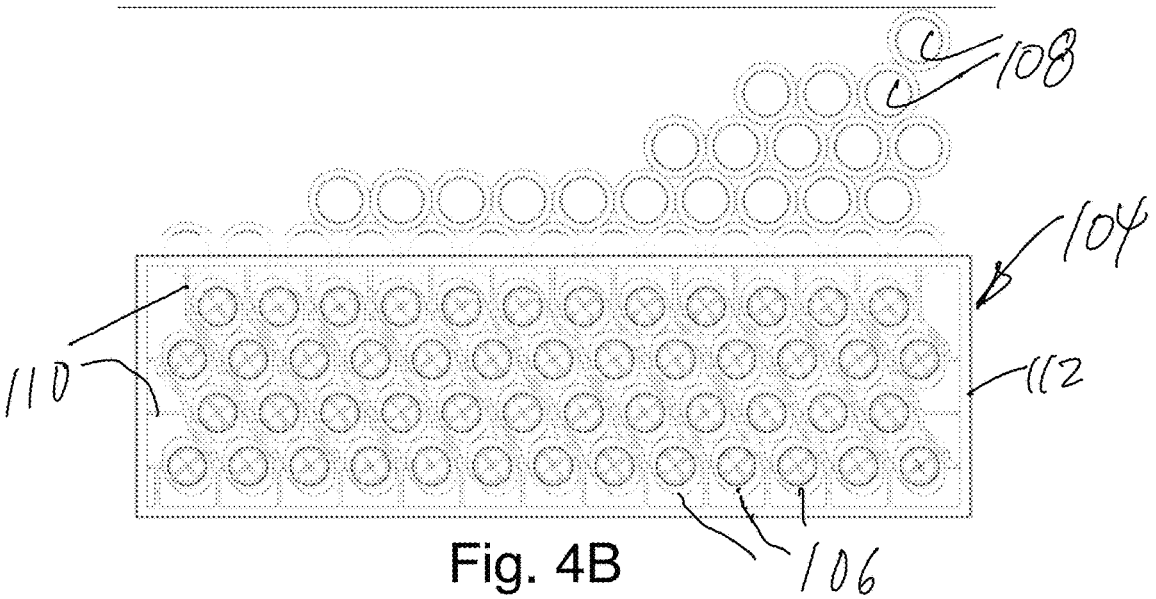
FIG. 4B shows a top view of the cap rack positioned over the matrix of bat pipes where the matrix of pegs found on the press tool match the matrix position of the smokable plant storage chambers of the glass bats.

FIG. 4A shows a side view of the alignment of the cap rack 104 over the top open ends 108 of the bat pipes 10 residing in the packing container 102 is shown. FIG. 4B shows a top view of the alignment of the cap rack 104 over the top open ends 108 of the bat pipes 10. The spacing of the caps 106 in the cap rack 104 are substantially the same as the spacing of the top open ends 108 of the bat pipes 10 when they are stored in the packing container 102. Thus, the cap rack 104 can be simply placed over the top open ends 108 of the bat pipes 10 and then the press tool 114 can be engaged to urge the caps 106 into the respective top open ends 108, as will be described in detail below. Still referring to FIG. 4B, the cap rack 104 need not have the same number of caps 106 and the associated press tool 114 need not have the same number of pegs 116 as the number of bat pipes 10 residing in the packing container 102. It is possible that the speed capping system 100 of the present invention can process less than all of the bat pipes 10 in a given capping operation. In other words, if the packaging container 102 is larger than the apparatus 100 of the present invention, the capping operation can be carried out in more than one operation whereby a first group of bat pipes 10 are capped using a first cap rack 104 by a first pressing operation with the press tool 114 and then a second group of bat pipes 10 in the same packing container 102 are capped using a second cap rack 104 by a second pressing operation using the same press tool 114. In such a case, the multiple bulk capping operations can be carried out so that the entire packing box 102 of bat pipes 10 are capped.

It is also possible that the packing container 102 houses the same number of bat pipes 10 as the number of caps 106 in the cap rack 104 using a press tool 114 with the same number of pegs 116. Thus, in this case, a single capping operation would secure caps 106 to all of the top open ends 108 of the respective bat pipes 10 residing in the packing container 102.

Turning now to FIGS. 5A-5D, the press tool 114 of the present invention is shown in detail. The press tool 114 is a handheld device that is preferably made from injection molded plastic but could be made in any type of material and in any way. It preferably has at least one handle 124, such as two handles, on opposing sides thereof. The press tool 114 can include a single handle 124 on its top surface or have no handle at all (not shown).

The press tool 114 includes a main body 126 with a bottom surface 122, which is preferably curved to aid in functionality, as seen in FIGS. 5A-5D. The bottom of the press tool is preferably curved but it could be of other configurations, such as flat. In such an embodiment of the press tool with a flat bottom surface with pegs residing thereon, the pressing operation would be in a linear downward direction rather than a rocking motion that is used with the embodiment of the press tool with a bottom surface 122 that is curved.

Figure 5A:
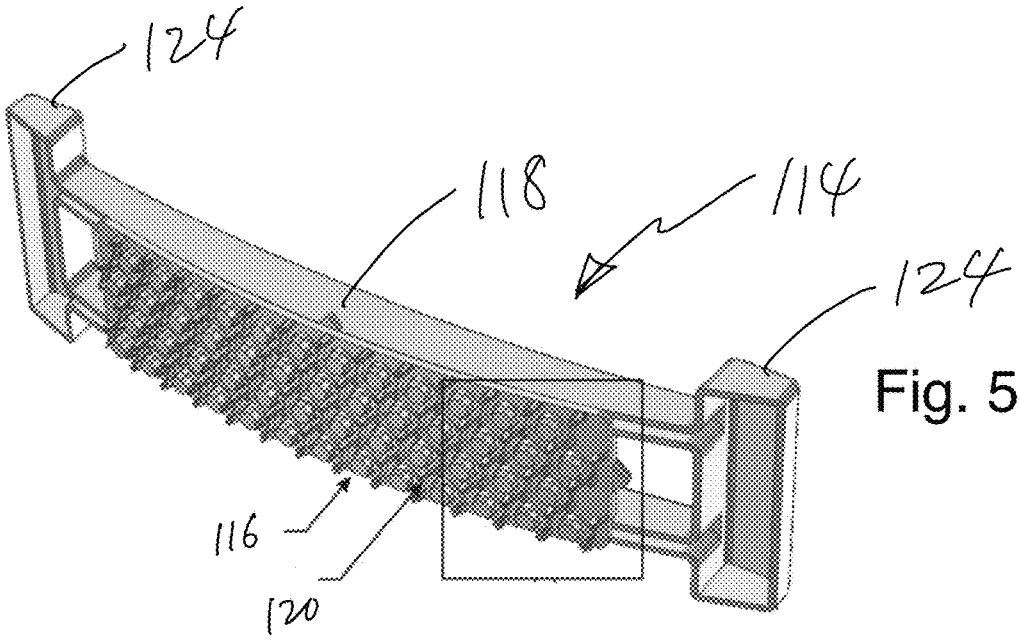
FIG. 5A is a bottom perspective view of the press tool.
Figure 5B:
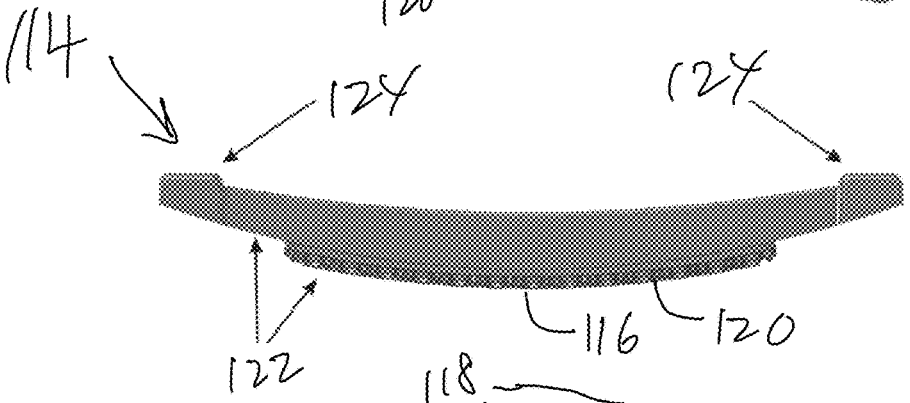
FIG. 5B shows a side elevational view of the press tool.
Figure 5C:
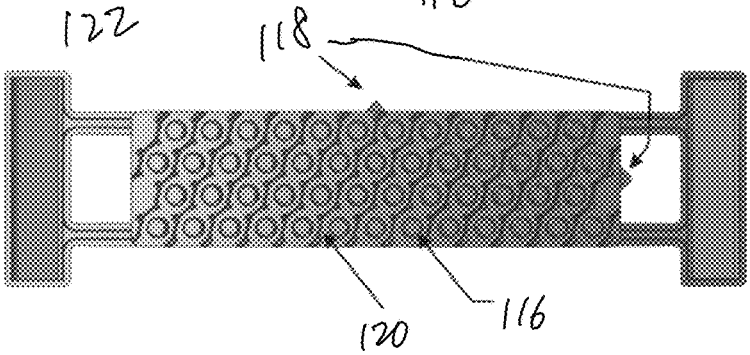
FIG. 5C shows a bottom view of the press tool.
Figure 5D:
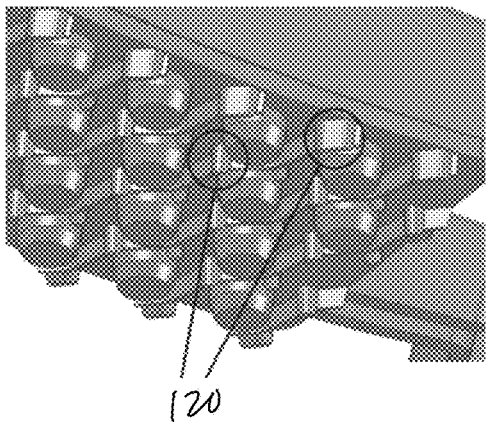
FIG. 5D shows a close-up bottom perspective view of the press tool.
Figure 6A:
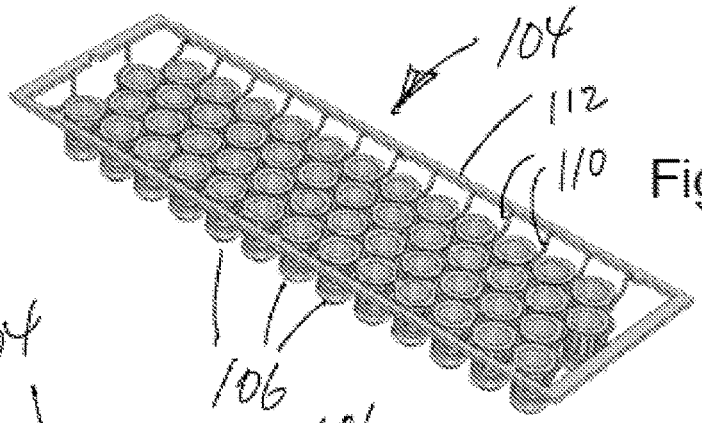
FIG. 6A shows a perspective view of the cap rack and its associated components, that can be molded as one complete part and can be use along with the press tool.
Figure 6B:
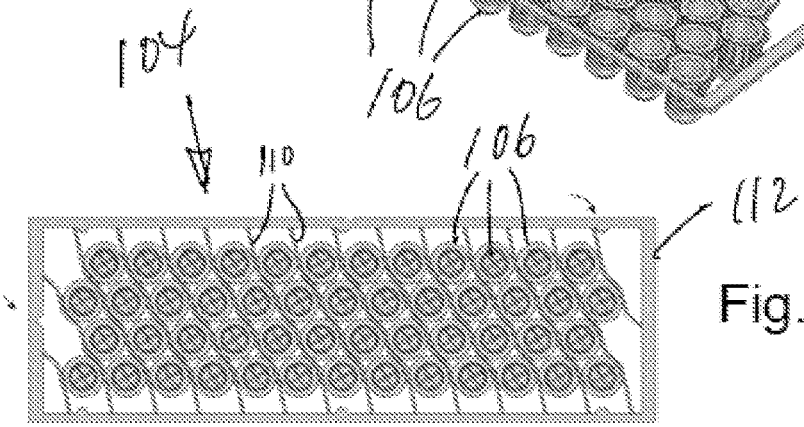
FIG. 6B is a top view of the cap rack and its associated components.
Figure 6C:
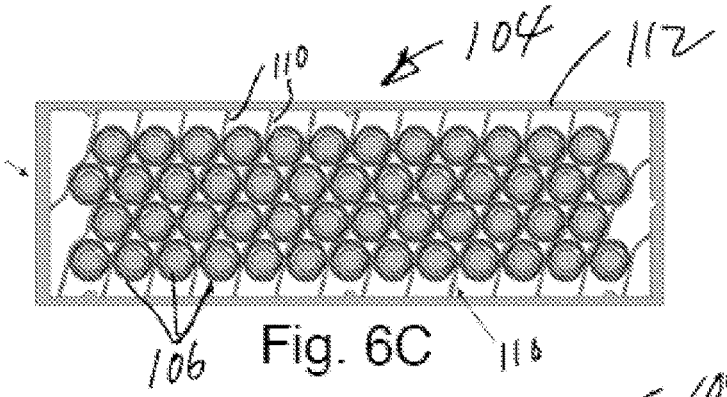
FIG. 6C is a bottom view of the cap rack and its associated components.
Figure 6F:
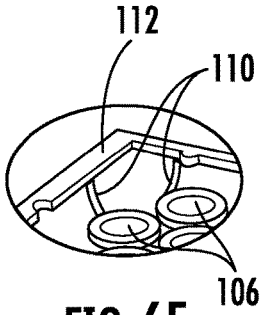
FIG. 6F shows a close-up perspective view of the cap rack.
Figure 6D:
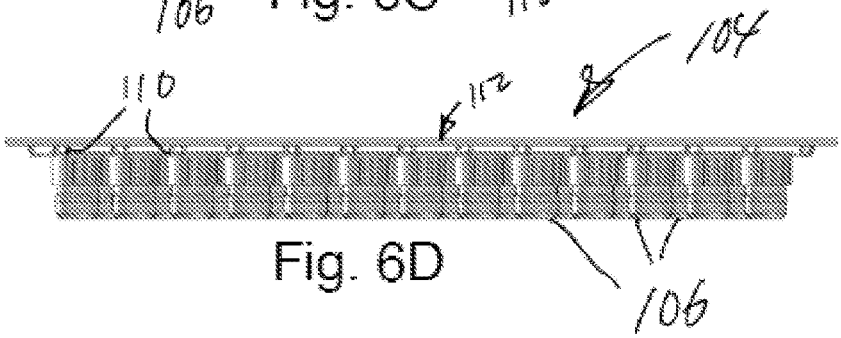
FIG. 6D is a side elevational view of the long side of the cap rack and its associated components.
Figure 6E:
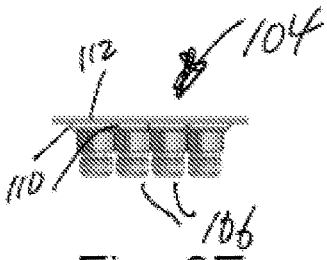
FIG. 6E is a side elevational view of the short side of the cap rack and its associated components.

Still referring to FIGS. 5A-5B, the press tool 114 includes a matrix of pegs 116 found on the bottom surface 122, which is curved in this embodiment 114. These pegs 116 help to align and locate the press tool 114 properly on the cap rack 104 by the pegs 116 engaging with cavities 128 found in the top face of the caps 106. Furthermore, the press tool 114 uses a number of ribs and rib posts 120 that engage with the runners 110 on the cap rack 104, as discussed below, that retain the caps 106 together within a matrix frame webbing 112 in the form of the cap rack 104. In addition, the press tool 114 preferably incorporates a number of alignment indicators 118 to help in positioning the press tool 114 to the cap rack 104 before the press tool 114 is urged downwardly into the cap rack 104 to, in turn, urge the caps 106 in the top open ends 108 of the bat pipes 10.

FIGS. 6A-6E show details of the cap rack 104 in accordance with the present invention. This component of the present invention includes a matrix of caps 106 connected to each by a frame or webbing 112, which facilitates the manufacture thereof, such as by injection molding. Also, such a matrix of caps 106 within a frame 112 pre-spaces out and aligns the caps 106 to the same or substantially the same spacing as the top open ends 108 of the bat pipes 10 that are residing in a packing container 102. This helps reduce capping time. More specifically, the caps 106 are arranged and configured to align with and fit in the open ends 108 of the smokable plant storage bat pipe chambers 14, namely when the bat pipes 10 are stored in a packing box 102 that is configured to align the top open ends 108 of the bat pipes 10 with the matrix of caps 106. The matrix of caps 106 of the cap rack 104 may have an array of caps 106 that is smaller than the number of bat pipes 10 in the storage box 102 but it is also possible that the matrix of caps 106 of the cap rack 104 may have an array of caps 106 that is the same than the number of bat pipes 10 in the storage box 102. The latter is particularly well-suited for smaller jobs where the container houses a smaller number of bat pipes 10 therein. Also, it should be understood that the size of the caps 106 and their spacing in the cap rack 104 can be modified to suit a given sized bat pipe, the size of its top open ends 108 and the packing container 102 into which the bat pipes 10 reside.

In addition to the caps 106, there are incorporated runners 110 and a frame 112 in the cap rack 104. The caps 106 are preferably attached to the frame 112 via a number of small integrated runners 110. These runners 110 hold the matrix of caps 106 into their proper location, alignment and orientation. These runners 110 in turn are attached to the frame 112. The frame 112 of the cap rack 104 also preferably incorporates a number of alignment indicators 130 to match with the alignment indicators 118 on the press tool 114 to help in positioning the press tool 114 over the cap rack 104 properly before it is actually pressed into place on the array of top open ends 108 of the bat pipes 10. The matrix of caps 106 and frame 112 are preferably molded together, such as by injection molding, for ease of manufacture and to provide a single unitary cap rack 104. The press tool 114 is also preferably molded out of plastic, such as by injection molding.

Referring now to FIGS. 3 and 7A-7D, the use of the apparatus 100 of the present invention to install caps 106 on bat pipes is shown in detail. Referring back to FIG. 3, the cap rack 104 is first aligned and placed over a selected number of bat pipes 10 (or all bat pipes depending on the number of bat pipes and the size of the packing box). The matrix of caps 106 in the cap rack 104 align with the top open ends 108 of the smokable plant chambers 14 of the bat pipes 10 residing in a packing box 102. The caps 106 within the cap rack 104 are of a layout that is substantially identical to the openings 108 of the smokable plant storage chambers 14 of the bat pipes 10 residing in the packing box 102. Therefore, the cap rack 104 is configured and arranged to align properly thereover. The cap rack 104 is then placed onto a section of the open ends 108 of the smokable plant storage chambers 14 of the bat pipe matrix then pressed slightly to seat.

Figure 7A:
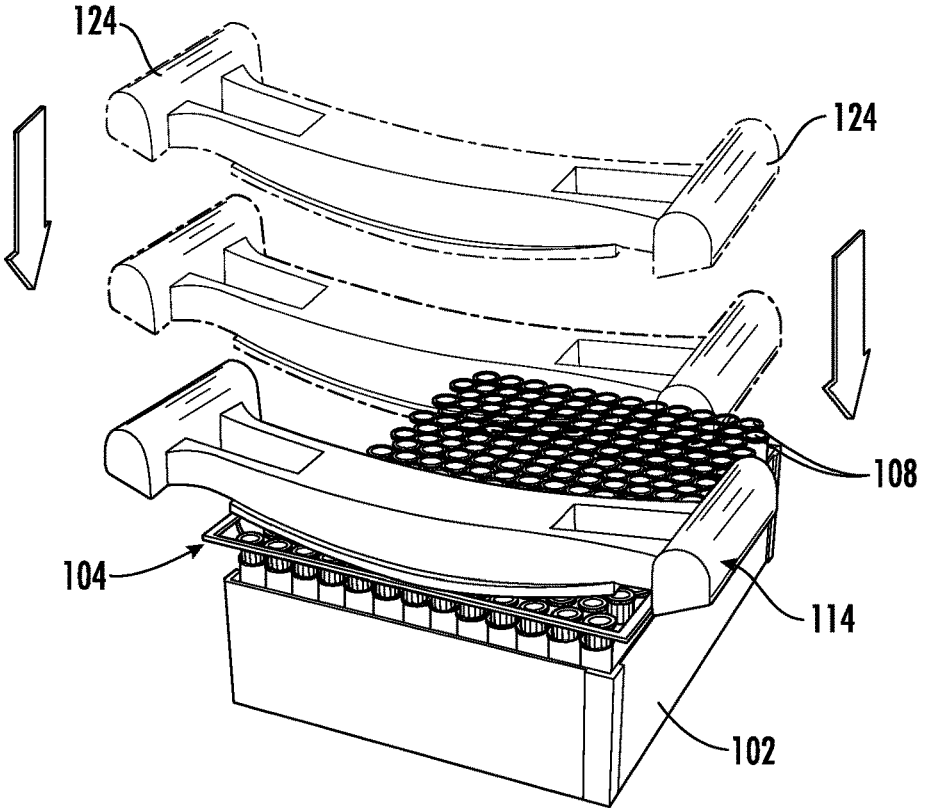
FIG. 7A shows the press tool in the process of matching alignment indicators on the press tool and cap rack to properly position the pegs of the press tool into the cap cavities found on the cap rack.
Figure 7B:
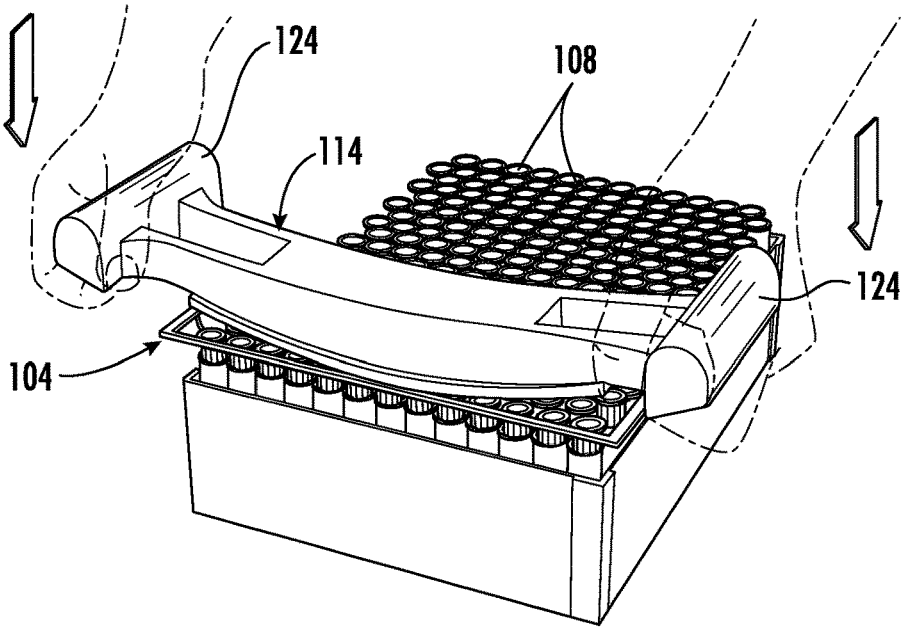
FIG. 7B shows the press tool in the process of compressing and seating the cap rack caps into position into the smokable plant storage chambers.
Figure 7C:
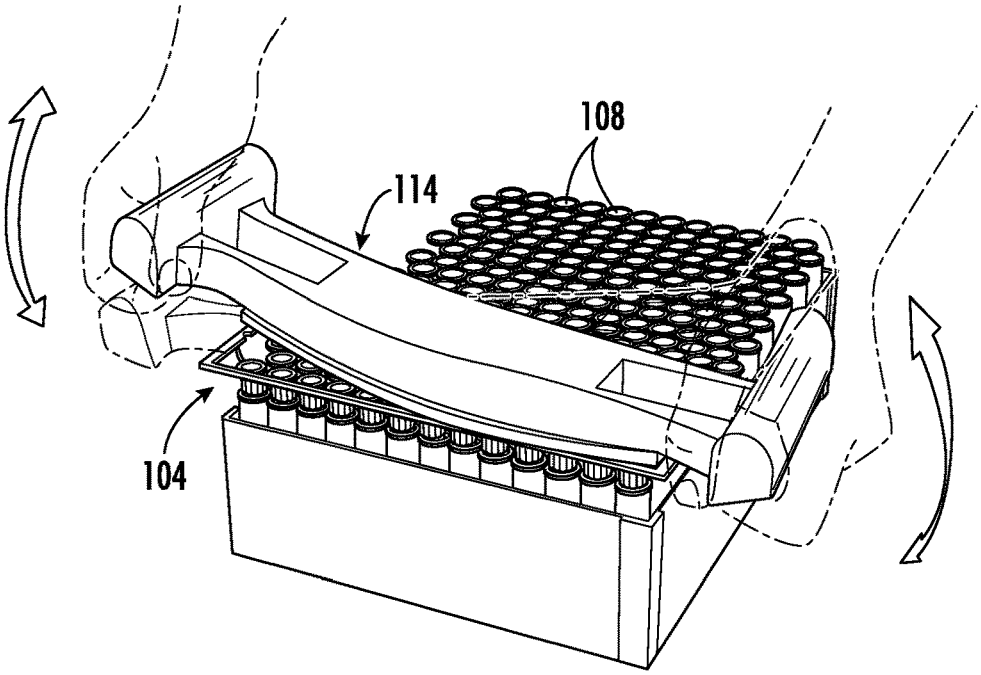
FIG. 7C shows the operation and functionality of the press tools curved bottom surface where the press tool is pushed down with the additional rocking feature helps to localize the pressure on the cap rack, thereby aiding in the release of the cap rack runners and frame from the cap rack part.

As in FIG. 7A, after the cap rack 104 is positioned in place on the top open ends 108 of the smokable plant storage chambers 14 (or less than all of the storage chambers if the cap rack 104 has less caps than the number of bat pipes 10), the press tool 114 is located on the top of the cap rack 104. An alignment marker 118 on the press tool 114 is aligned with an alignment marker 130 on the cap rack 104 to assist in placement of the press tool 114 in a co-extensive manner over the cap rack 104 so rocking the press tool 114 back and forth, as in FIG. 7C, engages all of the caps 106 across a given width of the cap rack 104.

Therefore, the press tool 114 both compresses and seats the caps 106 properly in place into the respective top open ends 108 of the smokable plant storage chambers 14 of the bat pipes 10. This is done by applying downward pressure with the press tool 114. In the current and preferred embodiment of the present invention, the bottom surface 122 of the press tool 114 has a slight curve. This curve surface allows the pressure to be focused down into the caps 106 in a localized area. In addition, the curved surface also allows the press tool 114 to be rocked from side to side. This motion helps to provide a controlled rolling transfer of this localized pressure across the matrix of caps 106 within the cap rack 104. This pressure is what forces the caps 106 down and seats them into position. In addition to seating the caps 106 fully/properly, the length of the caps 106, along with the downward pressure, can also effectively compress the smokable material 22 to the proper amount of compaction to allow for proper combustion. Various different caps 106 may be formed into the cap rack 104 to provide any desired interaction with the top open ends 108 of the bat pipes 10, level of compaction into smokable plant matter 22 residing in the top open ends 108 of the bat pipes which might be different depending on the consistency, amount of grind, for example, of the smokable plant matter 22.

Figure 8A:
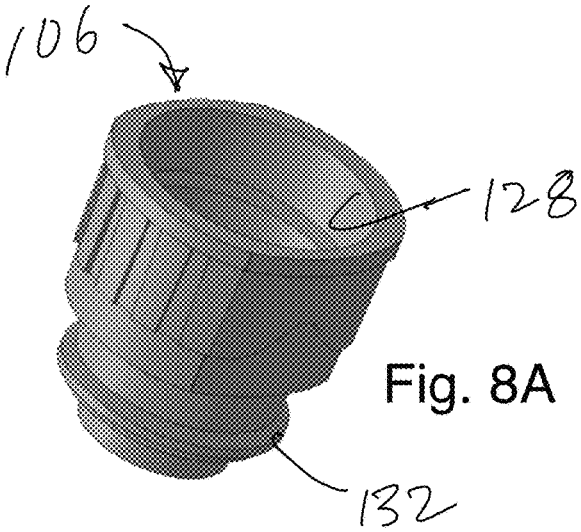
FIG. 8A shows a perspective view of an embodiment of a cap configuration that may be employed in the frame and runners in accordance with the present invention.
Figure 8F:
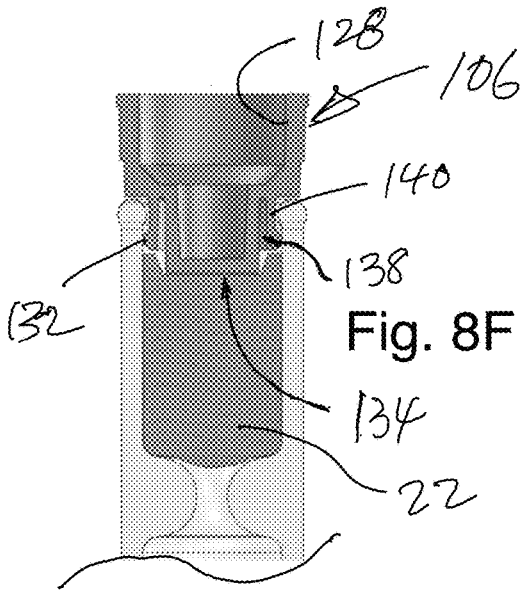
FIG. 8F is a side partial cross-sectional view of the cap configuration of FIG. 8A installed in a bat pipe.
Figure 8B:
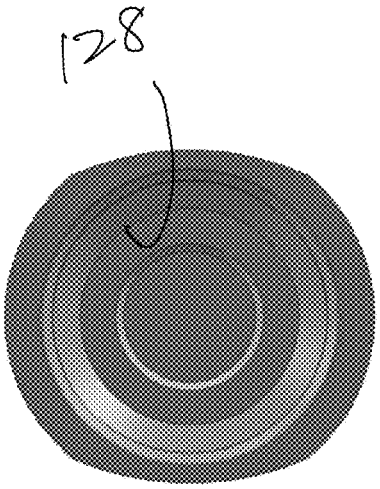
FIG. 8B is a top view of the cap configuration of FIG. 8A.
Figure 8C:
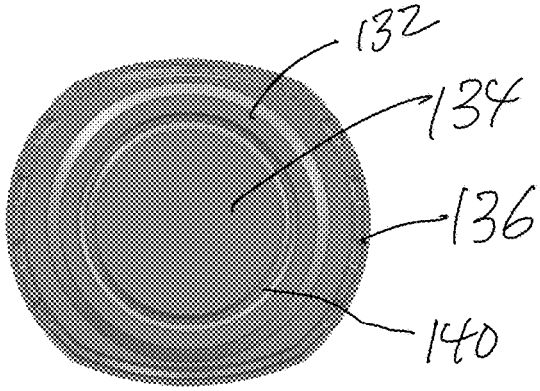
FIG. 8C is a bottom view of the cap configuration of FIG. 8A.
Figure 8D:
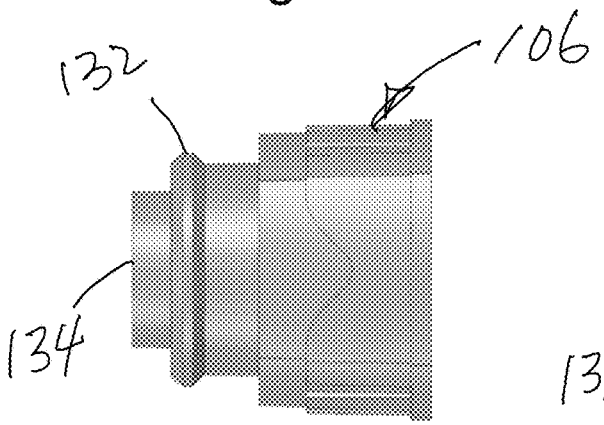
FIG. 8D is a front side view of the cap configuration of FIG. 8A.
Figure 8E:
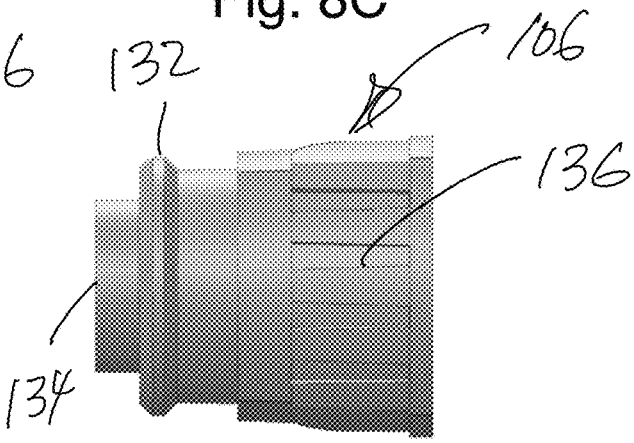
FIG. 8E is a left side view of the cap configuration of FIG. 8A.

As shown in FIGS. 8A-8E, for example, the caps 106 can include an upper open end 108 to receive the pegs 116 of the press tool 114, a sealing ring 132 and a smokable plant matter compaction surface 134 on the bottom thereof. Also, the plug-like end 134 includes a thick wall to aid in ejecting the part. A gap 138 allows outer wall 140 to be flexible for better sealing action by the sealing ring 132. Knurling 136 on the sides of the cap 106 may be provided to facilitate removal of the cap 106 and later reinstallation of the cap 106, if needed. FIG. 8F further shows the cap 106 installed in place on a bat pipe with smokable plant matter 22 secured therein.

The structure and configuration of cap 106 is very specific and well-suited to being configured in the cap rack 104 for installation into a bat pipe 10 in accordance with the present invention. When inserting multiple caps 106 into multiple bat pipes 10, there is a certain amount of force buildup required to press the caps 106 into place. The cap configuration of FIGS. 8A-8F helps to eliminate the excess force by locating the sealing ring 132 at the end of a floating outer wall. This allows for a more flexible ring 132 thereby providing a lower insertion force of the caps 106 into the glass bats 10 while still maintaining a solid/flat bottom surface 134 that is necessary to compress the smokable plant matter 22.

Figure 7D:
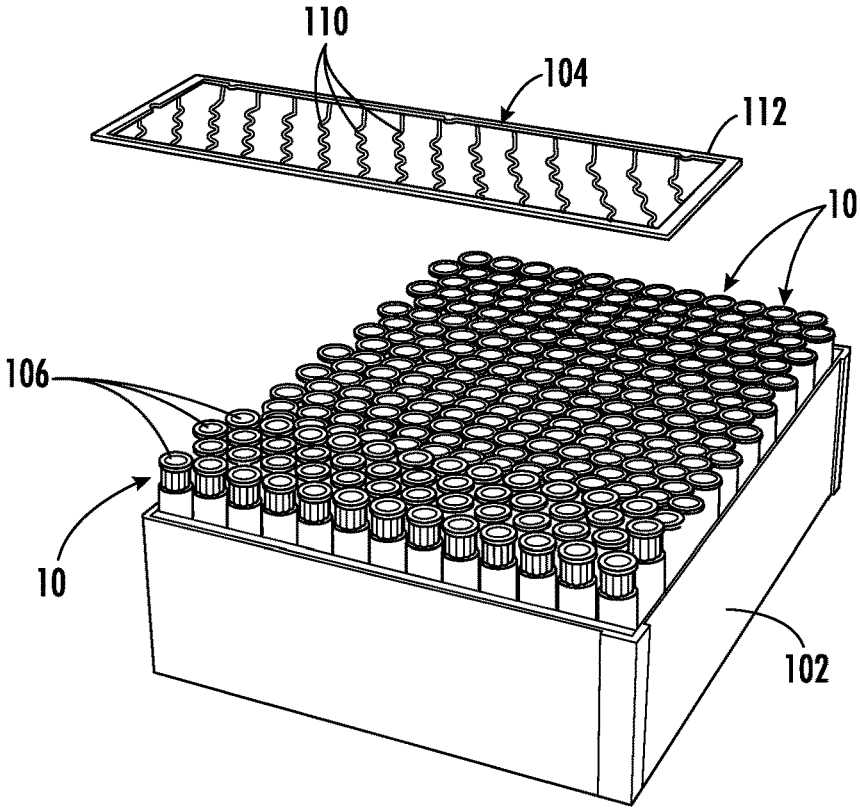
FIG. 7D shows the final step of removing the runner and frame elements from the cap rack at which point the bat pipes are all cap sealed, still in packing box and ready for processing to customers.

Also, as seen in FIG. 7D, the press tool 114 also releases the matrix of caps 106 from the runners and frame upon imparting downward force into the cap rack 104. This is carried out when downward pressure pushes the ribs and rib posts 120, found on the curved underside 122 of the press tool 114, downward into the cap rack 104. A bottom surface 122 of the press tool 114 that is curved facilitates the pressure to be focused down onto the runners 110 in a localized area, particularly if the cap rack 104 is of a larger size. This downward pressure engages the runners 110 and forces them downward and, as a result, to separate or shear from the caps 106, thereby leaving the caps 106 free of the runners 110 and frame 112 and also now installed in their respective bat pipes 10. The press tool 114 can then be removed. Then, the runners 110 and frame 112 can be pulled away from the now seated and installed caps 106 and be discarded or recycled.

In addition, to prevent the runners 110 from flexing out of the way and not properly shearing, the rib posts 120 straddle the thin runners 110 to ensure that they are fully engaged and properly captured during compression. A bottom surface 122 of the press tool 114 that is curved allows it to be rocked from side to side to encourage this separation. This motion helps to provide a controlled rolling transfer of this localized pressure across the runners 110 of the cap rack 104. If the cap rack 104 has a smaller number of caps 106 therein, for example 18 caps for the capping of a smaller packing container 102 of 18 bat pipes, an alternate embodiment of a smaller complementary one-handed press tool 214, as seen in FIGS. 9A-9D, may be used. This smaller press tool 214, with its pegs 216, alignment marker 218, ribs 220, and handle 224 and may still have a bottom surface 222 that is curved so the rocking action installation can be used.

Figure 9A:
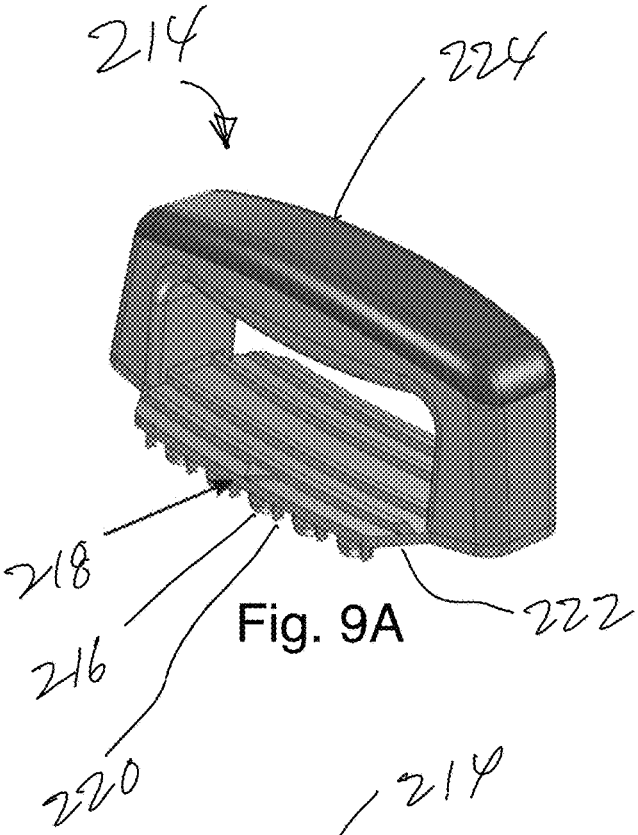
FIG. 9A is a top perspective view of an alternative embodiment of a one-handed press tool that may be employed in accordance with the present invention.
Figure 9B:
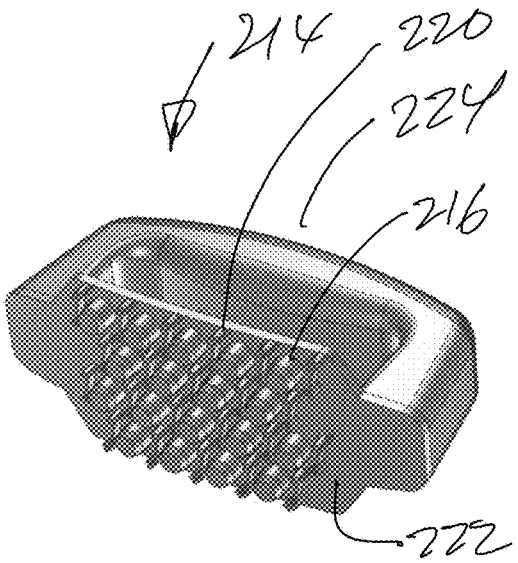
FIG. 9B is a bottom perspective view of the press tool of FIG. 9A.
Figure 9C:
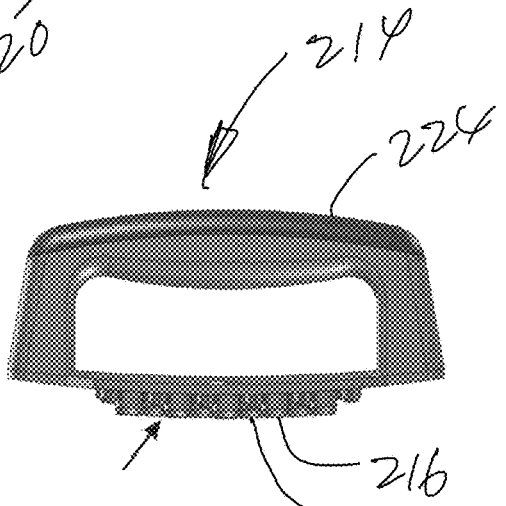
FIG. 9C is a side elevational view of the press tool of FIG. 9A.
Figure 9D:
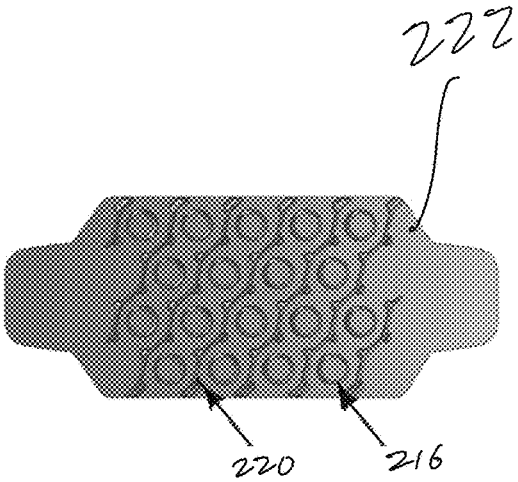
FIG. 9D is a bottom elevational view of the press tool of FIG. 9A.

On the other hand, the press tool 114, 214, whether it is of a larger size in FIGS. 5A-5B or of a smaller size of FIGS. 9A-9B, the bottom surface 122, 222 may be flat whereby a single downward linear force is applied to the press tool 114, 214 to urge it into communication with the cap rack 104. Regardless of the number of bat pipes 10 to be capped, it may be more desirable to use a press tool 114, 214 with a flat bottom surface, for example, if the particular smokable plant matter 22 filled in the bat pipes 10 or the caps 106 being used, are more suited for a single downward force capping operation rather than a rocking side to side capping operation.

Once the discarded cap rack runner 110 and frame 112 waste material is removed, what remains is packed and sealed bat pipes 10 with caps 106 on each bat pipe 10 with smokable plant matter 22 in each respective bat pipe 10 left remaining in the packing container box 102. Furthermore, method of the present invention is carried out entirely while the bat pipes 10 are seated in a packing container box 102. Thus, the bat pipes 10 are capped off without removing the bat pipes 10 from the packing container box 102, which greatly facilitates and speeds up the filling and capping process. The resultant filled and capped bat pipes, all residing in a packing container 102 can then be shipped to a seller of the pre-filled bat pipes 10 for sale at retail, transported or stored, all without removing the filled and capped bat pipes 10 from the packing container.

It will be appreciated by those skilled in the art that various changes and modifications can be made to the illustrated embodiments without departing from the spirit of the present disclosure. All such modifications and changes are intended to be covered by the appended claims.

What is claimed is:

1. An apparatus for capping bat pipes have top open ends, comprising:

a cap rack having a frame, runners and a matrix of caps; the matrix of caps being alignable with and positioned over top open ends of bat pipes;

a press tool having a main body with a bottom surface:

a matrix of pegs and ribs on the bottom surface of the press tool; the matrix of pegs having a matrix configuration that is substantially the same as the matrix of caps; the ribs residing between the pegs;

whereby downward pressure of the press tool into the cap rack presses the matrix of caps into respective top open ends of the bat pipes;

whereby the ribs of the press tool separates the frame and runners of the cap rack from the matrix of caps, whereby the caps are freely and individually movable, thereby leaving the matrix of caps seated in respective top open ends of the bat pipes while allowing the frame and runners to be removed and discarded.

2. The apparatus of claim 1, wherein the bottom surface of the press tool is curved or flat.

3. The apparatus of claim 1, further comprising:

at least one handle connected to the main body of the press tool.

4. The apparatus of claim 1, wherein the cap rack and press tool are made of molded plastic.

5. The apparatus of claim 1, wherein the bat pipes are configured and arranged in a packing container with their respective top open ends facing upwards.

6. The apparatus of claim 5, wherein the cap rack includes a number of caps that is less than the number of bat pipes configured and arranged in the packing container.

7. The apparatus of claim 5, wherein the cap rack includes the same number of caps as the number of bat pipes configured and arranged in the packing container.

8. A method for capping bat pipes, comprising the steps of:

providing an array of bat pipes with top open ends;

providing a cap rack having a frame, runners and a matrix of caps;

aligning the matrix of caps respectively over the top open ends of array of the bat pipes;

providing a press tool having a main body with a matrix of pegs and ribs residing thereon and between the pegs;

aligning the matrix of pegs of the press tool over the matrix of caps;

applying downward pressure of the press tool into the cap rack thereby pressing the matrix of caps into sealed engagement with respective top open ends of the bat pipes; and wherein downward pressure of the ribs of the press tool into the cap rack separates the frame and runners of the cap rack from the matrix of caps, whereby the caps are freely and individually movable, thereby leaving the matrix of caps seated in respective top open ends of the bat pipes while allowing the frame and runners to be removed and discarded.

9. The method of claim 8, wherein the bottom surface of the press tool is curved or flat.

10. The method of claim 8, further comprising the step of:

providing at least one handle connected to the main body of the press tool.

11. The method of claim 8, wherein the cap rack and press tool are made of molded plastic.

12. The method of claim 8, further comprising the step of:

providing a packing container with a top open end; and configuring and arranging the bat pipes in the packing container with their respective top open ends facing upwards at the top open end.

13. The method of claim 12, wherein the cap rack includes a number of caps that is less than the number of bat pipes configured and arranged in the packing container.

14. The method of claim 12, wherein the cap rack includes the same number of caps as the number of bat pipes configured and arranged in the packing container.

* * * * *